United States Patent [19]

Wombles et al.

[11] 4,456,524

[45] Jun. 26, 1984

[54] PROCESS FOR ENHANCING CATALYTIC RESPONSE OF ASPHALT OXIDATION CATALYST

[75] Inventors: Robert H. Wombles, Worthington; Charles R. Gannon, Ashland; Donald D. Carlos, Louisville, all of Ky.

[73] Assignee: Ashland Oil, Inc., Ashland, Ky.

[21] Appl. No.: 364,749

[22] Filed: Apr. 2, 1982

[51] Int. Cl.[3] ..... C10G 27/00; C10G 27/04

[52] U.S. Cl. ..... 208/5; 208/6

[58] Field of Search ..... 208/5, 6

[56] References Cited

U.S. PATENT DOCUMENTS

| | | | |
|---|---|---|---|
| 1,782,186 | 11/1930 | Abson | 208/5 |
| 2,179,208 | 11/1939 | Burk et al. | 208/5 |
| 2,276,155 | 3/1942 | Carr | 208/6 |
| 2,287,511 | 6/1942 | Burk et al. | 208/5 |
| 2,317,150 | 4/1943 | Louell et al. | 208/6 |
| 2,370,007 | 2/1945 | Carr | 208/5 |
| 2,421,421 | 6/1947 | Hoiberg | 208/5 |
| 2,906,687 | 9/1959 | Roediege et al. | 208/6 |
| 3,126,329 | 3/1964 | Fort | 208/4 |
| 3,440,073 | 4/1969 | Fowler | 208/6 |
| 4,202,755 | 6/1980 | Spiegelmann | 208/5 |

*Primary Examiner*—Delbert E. Gantz
*Assistant Examiner*—Helane E. Maull
*Attorney, Agent, or Firm*—Richard C. Willson, Jr.

[57] ABSTRACT

Sodium carbonate, sodium sesquicarbonate and other carbonate catalysts ground to fine particle sizes (95% plus passing through a 200 mesh sieve (75 $\mu$m) are more active than commercially available grades of such catalysts when oxidizing asphalt fluxes, permitting reduction in oxidation time, reduction in required catalyst quantities and improvement in product quality.

34 Claims, No Drawings

PROCESS FOR ENHANCING CATALYTIC RESPONSE OF ASPHALT OXIDATION CATALYST

The present application is related to the general field of the following U.S. patent applications: U.S. Ser. No. 210,010 filed Nov. 24, 1980; U.S. Ser. No. 320,916 filed Nov. 12, 1981.

BACKGROUND OF THE INVENTION

1. Field of the Invention

The present invention relates to the oxidation of bituminous materials especially for the preparation of high grade asphaltic materials particularly suited for use in paving and roofing applications.

2. Prior Art

Historically, paving grade asphalts were produced by the refiner by various methods or combinations of methods such as atmospheric distillation of crude oil with subsequent vacuum distillation to obtain the desired asphaltic product. Another method is air blowing, with or without an oxidation catalyst, a soft vacuum tower residual at 350° to 550° F. (177° to 288° C.) either by a batch method or continuous in line oxidation to the desired product specification. Another method is to solvent precipitate a soft vacuum tower residual to product specifications; and still another method is to solvent precipitate a soft vacuum tower residual to a low penetration hard asphalt followed by back blending with a softer vacuum bottoms to achieve the proper specification characteristics.

All of the aforementioned methods can be used singularly or in combination to produce high quality asphaltic products. The choice of methods, in reality, is dependent upon the crude type. This invention is concerned with the above processes where air blowing in the presence of a finely ground (comminuted) oxidation catalyst is employed. We have discovered that by using a much smaller percentage of the finely ground catalyst of the present invention, the "blowing curve" of the asphalt flux can be altered to produce a product having a higher penetration at a given softening point and in remarkably shorter time. As can be appreciated, both of these attributes are of considerable economic value.

In the past, bituminous materials, particularly asphalt materials, have been treated by passing an oxidizing gas through the bituminous materials in a molten condition. The effect of the conventional type of air blowing is to partially oxidize the asphalt in a manner resulting in decreasing penetration and increasing viscosity and softening point. To promote the oxidation process, oxidizing catalysts have been utilized in the past. U.S. Pat. No. 1,782,186 states that the chloride, carbonate and sulfate salts of zinc, iron, copper or antimony can be used as catalyst in air blowing petroleum residuals to asphaltic materials. U.S. Pat. No. 1,782,186 exemplifies only the use of the chloride salt. Also, U.S. Pat. Nos. 2,179,208 and 2,287,511 describe processes for making asphalt. In all of the examples of the '208 and '511 patents, residium is first air blown and then "polymerized" using halides of certain metals as catalysts. These two patents list other catalyst possibilities, including sodium carbonate. U.S. Pat. No. 3,440,073 to Loren M. Fowler and Harry D. Hurrell, discloses a method for deodorizing asphalt for use as sealants in refrigerators and freezers wherein air and steam are blown through molten asphalt flux to which has been added a small or minor quantity of a water solution of one or more water-soluble inorganic alkaline materials, such as sodium hydroxide, sodium carbonate, potassium hydroxide and potassium carbonate. The primary purpose of said treatment is to deodorize asphalt for special applications. Other patents of relevance to this invention are U.S. Pat. Nos. 2,370,007 to Donald E. Carr; 2,421,421 to Arnold J. Hoiberg; and 3,126,329 to Jean Fort.

Penetration by definition is the consistency of a bituminous material expressed as the distance in tenths of a millimeter that a standard needle vertically penetrates a sample of material under known conditions of loading, time, and temperature. In essence, the penetration of a bituminous material is synonymous with viscosity at the temperature specified.

Viscosity may simply be defined as the measure of the resistance to flow of a liquid in the presence of a force. It has been shown desirable in asphalts such as paving asphalts to have a high penetration at a given viscosity. For example, an asphalt pavement constructed with asphalt cement having a penetration (ASTM D5) of 40, viscosity (ASTM D2171) at 140° F. (60° C.) of 2000 poises, and a viscosity (ASTM D2171) at 275° F. (135° C.) of 300 centistokes would not perform as well as the same asphalt having the same viscosities but a penetration of 60. The 40 penetration asphalt at lower temperatures (below 77° F. (25° C.)) would become brittle and break up under repeated traffic load. In other words, the 40 penetration asphalt at 77° F. (25° C.) is more susceptible to changes in temperature.

One object of this invention is to catalytically produce a paving grade asphalt which is less susceptible to changes in temperature. Another object of this invention is to reduce the oxidation time. Another object of this invention is to reduce the quantity of catalyst required. Another object of this invention is to provide an improved process for producing said asphalt. Still another object of this invention is to provide an improved and novel paving grade asphalt product.

Roofing asphalts are markedly different from paving asphalts. The air blowing process is frequently employed to manufacture certain paving grade asphalts; however, all roofing asphalts are manufactured by the air blowing process. One very important similarity exists between paving grade asphalts and roofing asphalts, i.e., a higher penetration at a give softening point is desirable. In other words, it is desirable to produce a roofing asphalt which is less susceptible to temperature change. Roofing manufacturers have historically used softening point which, in essence, is another method to designate viscosity.

Some roofing fluxes (roofing asphalt precursors) can be air blown to specifications without the use of a catalyst. Some require a catalyst. The use or non-use of a catalyst usually depends on the type of crude from which the roofing flux is derived. Refiners and asphalt roofing manufacturers have historically utilized Lewis acid catalysts such as halides of iron, aluminum, copper, tin, zinc, antimony, as well as phosphorus pentoxide in the production of roofing grade asphalts. Ferric chloride and phosphorous pentoxide are presently the most commonly used catalysts. These catalysts work quite well except they are very corrosive, and the amount of maintenance required on storage tanks, fume burners, pumps, etc. amounts to millions of dollars annually. In addition, the Lewis acid catalyzed asphalts deterioriate cellulosic-based products, such as roofing felts, spreding mops, etc., which are used during the manufacturing and application processes.

One of the objects of this invention is to catalytically produce a novel roofing asphalt which is less susceptible to changes in temperature. Another object of this invention is to reduce processing costs, and increase operating capacity by reducing the time for air blowing a roofing flux to roofing asphalt specification requirements. The reduction in total oxidation time is associated with the accelerated catalytic initiation of the oxidation reaction causing a pronounced exotherm. Another object of this invention is to reduce the amount of catalyst required. Another object of this invention is to greatly reduce maintenance costs by utilizing a new non-corrosive, inexpensive, readily available catalyst. A further object of this invention is to provide a roofing asphalt which does not deteriorate cellulosics used in the roofing manufacturing and application processes. It is also an object of this invention to achieve an end product improvement over roofing asphalts produced by conventional catalysts known to the art such as ferric chloride, phosphorous pentoxide, etc. Another object of this invention is to produce, by catalysis, a novel, improved roofing material from a bituminous material which, when subjected to the normal non-catalytic air blowing process produces inferior roofing asphalts. Another object of this invention is to produce, by catalysis, a superior asphaltic roofing material exceeding specifications from a bituminous material which, when subjected to the normal non-catalytic air blowing process, produces only acceptable quality roofing asphalt. Another object of this invention is to provide improved catalytic processes for producing said asphalt.

Further objects of this invention will be apparent to the skilled artisan from the Summary and Detailed Description of the Invention, hereinbelow.

SUMMARY OF THE INVENTION

Briefly stated, the present invention comprises an improvement to the process more fully described in U.S. Ser. No. 320,916 filed Nov. 12, 1981 by the present inventors. U.S. Ser. No. 320,916 teaches the use of catalyst in the process of oxidizing bituminous materials to produce high grade asphaltic materials. The preferred catalysts are carbonate salts and the most preferred catalysts are carbonates and bicarbonates of sodium, calcium, magnesium, cerium, barium, strontium, lithium, ammonium, potassium, bismuth, lead, tetraalkylphosphonium, tetraarylphosphonium, tetraalkylammonium, trialkylammonium, dialkylammonium, transition metals or rare earth metals.

U.S. Ser. No. 320,916 teaches the use of substantial amounts of such catalyst e.g. preferably from about 0.01 to about 5 weight percent, more preferably from about 0.1 to about 2 weight percent of catalyst based on the weight of said bituminous material.

The present invention has discovered that by relatively simple and well-known techniques of comminution or other size reduction techniques, the efficiency and effectiveness of the catalyst disclosed in U.S. Ser. No. 320,916 can be greatly increased with savings in the amount of catalyst used and the resultant costs and with attendant improvements in product quality. Perhaps more important, the time required for oxidation to a given product quality can be substantially reduced by the use of techniques of the present invention and this provides greater productivity in an existing reactor and permits reduction in capital expenditure for new reactors by permitting greater productivity from smaller reactors.

According to the present invention, the carbonate salt catalysts are, before addition to the bituminous materials, comminuted by grinding or other size reduction techniques.

Preferably, the catalyst will be ground to have an average particle size of less than about 200 mesh (75 μm) (all mesh sizes are based on the U.S. standard screen size). More preferably 100% of the catalyst will pass through a 200 mesh (75 μm) screen. In reality, the finer a catalyst is ground, the greater its reactivity. The apparatus and grinding techniques utilized for the present invention are narrowly critical and include the use of ball and rod mills, hammer mills, roller mills of conventional or hydraulically enhanced design, mortar and pestle (for experimental quantities), specialized crushing techniques, fluid energy mills, e.g. Majac mills, spray drying techniques, and slurry grinding techniques, and colloid mills. These are well known and illustrated by many patents in the U.S. Patent Office.

Also, a wide variety of techniques may be utilized for injection of the catalyst into the bituminous feed materials. For example, all of the techniques taught by copending U.S. Ser. No. 320,916 are applicable here and all the references cited therein are incorporated herein by reference.

The term "catalyst" as used herein should not be narrowly construed and should be understood to include any use of the carbonate salts herein described by addition to bituminous feed materials for the production of high grade asphalts, whether or not such "catalysts" react in whole or in part with the feed materials employed.

The temperature employed for the process of the present invention will generally be in the range of about 300° F. (175° C.) to about 550° F. (288° C.), more preferably from about 450° F. (232° C.) to about 550° F. (288° C.) but this range is not narrowly critical.

Likewise, the time for the oxidation to proceed is not narrowly critical but will generally be in the range from about 0.5 to about 50 hours, more preferably from about 5 to 30 hours and most preferably in the range from about 1 to about 24 hours, but this will vary greatly depending upon the particular raw materials employed, design of reaction vessel, and the particular specification of the asphaltic materials desired to be produced. In most cases, the techniques of the present invention, as compared to the use of standard commercial carbonate salts, will permit a reduction of from 10% to as much 30% in the time required for oxidation to produce a product of the same specification from the same raw materials.

DETAILED DESCRIPTION OF THE INVENTION

(Batch Process)

Generally speaking, air blowing or oxidation of bituminous flux materials by the batch process is carried out as follows: Horizontal, or more commonly, vertical vessels with some means of heating such as direct fired burners, high pressure steam heat exchangers, etc. capable of maintaining temperatures up to 550° F. (288° C.) are employed. Various methods of controlling and dispersing the oxidizing gas through the molten flux material are used. Most "batch oxidizers" are equipped with a cooling device such as a heat exchanger within or outside the vessel or a system for spraying water or injecting steam onto the surface of the molten flux. The aforementioned process can be used to produce paving grade asphalt cements or roofing asphalts.

(Continuous Process)

Another oxidation process is a continuous process whereby a fresh bituminous feedstock material is continuously charged or fed into an oxidizer wherein catalyst and an oxidizing gas are continuously and concurrently dispersed and contacted with the molten material on a "once-through" basis. The product, i.e., asphaltic material, is continuously discharged from the oxidizer. The process can be used for any type of bituminous feedstock material and is particularly useful in producing paving grade asphalt cements.

EXAMPLE I

Conventional oxidation (without catalyst) of low grade asphalt fluxes to produce paving grade asphalt cements Vacuum residua from many crude oils normally do not yield specification products when subjected to the air blowing or oxidation process. The asphalt fluxes described in Examples I through XI are in this category. The starting flux is made in the refinery by topping the crude oil by distillation under atmospheric conditions to produce a reduced crude residual. Said reduced crude residual is further distilled under reduced pressure to obtain a soft vacuum residual. Said soft vacuum residual, having a viscosity greater than about 400 SFS at 210° F. (99° C.), without a catalyst, is used as a feed to a 500 ml laboratory batch oxidizer. The temperature of said flux is raised to 480° F. (249° C.) in one hour. At this time, air is injected and dispersed into the oxidizer at a rate equivalent to 50 cu. ft./hr./ton. Said air rate remains constant and the temperature is maintained at 480° to 500° F. (249° C. to 260° C.) until the ASTM D5 penetration on the blown flux reaches a range of 60–70. The aforementioned asphalt flux (derived from a poor quality crude stock) and process are used as a "blank" or "control" to realistically illustrate the effect of commercially available unground and finely ground catalyst of the present invention. The AC-20 asphalt cement thus produced without a catalyst only minimumly meets specification requirements. (Table I)

EXAMPLE II

Oxidation of low grade asphalt flux with unground commercial grade catalyst to produce paving asphalt cement The identical asphalt flux, air rate, and temperatures, etc. as used in Example I are used in successive separate oxidations, except 1.0%, by weight of sodium carbonate (unground), based on flux, is added to the oxidizer. Table I shows the changes in the physical properties of the starting flux oxidized to AC-20 asphalt cement specifications without a catalyst (Example I) compared with the identical flux oxidized with 1.0% unground commercial grade sodium carbonate catalyst. Specifications are met and the oxidizing time is reduced from 8 to 3.5 hours. (Table I)

EXAMPLE III

Oxidation of low grade asphalt flux with finely ground catalyst of present invention to produce paving grade AC-20 asphalt cement.

The identical asphalt fluxes, air rates, temperatures, etc. as used in Examples I and II are used in successive separate oxidations except 1.0% and 0.5% finely ground sodium carbonate are used as catalysts. Table I shows the changes in physical properties of the starting flux oxidized to AC-20 asphalt cement specifications without a catalyst (Example I) compared with the identical flux oxidized with commercial unground sodium carbonate (Example II) compared with 0.5% and 1.0% respectively of finely ground <200 mesh (75 μm) sodium carbonate. The use of 1.0% finely ground sodium carbonate reduced the oxidation time and enhanced the physical properties of the finished product. The use of 0.5% finely ground sodium carbonate reduced the oxidation time and altered the physical properties to meet product specification requirements thus proving that the catalyst response is markedly enhanced by the addition of finely ground sodium carbonate catalyst.

EXAMPLE IV

Conventional non-catalytic oxidation of low grade asphalt flux to produce roofing asphalt.

An asphalt flux having a viscosity range of about 50–400 SFS at 210° F. (99° C.), derived from a low grade crude stock, is oxidized using the identical process described in Example I except said flux was oxidized to a softening point of 220° to 235° F. (104° to 113° C.) to meet specification requirements for roofing coating asphalt. The proper specification softening point of 232° F. (111° C.) is obtained but the penetration is too hard (15) to meet the specification requirements.

(Table II)

EXAMPLE V

The identical flux and process cited in Example IV is catalyzed with unground commercial grade sodium sesquicarbonate to meet softening point specification requirements. At a 232° F. (111° C.) softening point a penetration of 19 was obtained which met specification requirements. (Table II) Oxidation time is reduced one hour. (FIG. 1)

EXAMPLE VI

The identical flux and process of Example V was used except 1.0% finely ground <200 mesh (75 μm) sodium sesquicarbonate is used to catalyze the oxidation. The oxidation time was reduced by 2½ hours compared with example IV and by 1½ hours when compared with Example V. (FIG. 1) Specifications were met. (Table II)

EXAMPLE VII

The identical flux and process of Example V is used except 1.0% commercial grade unground sodium carbonate is used to catalyze the oxidation. The finished roofing coating product met specifications. (Table II) The oxidation time was reduced by three hours compared with Example IV where no catalyst was used. A reduction of two hours is observed when compared with Example V where unground commercial grade sodium sesquicarbonate catalyst is used and a reduction of 0.5 hours when compared with Example VI where finely ground <200 mesh (75 μm) sodium sesquicarbonate catalyst is used. (FIG. 1)

EXAMPLE VIII

The identical flux and process of Example V is used except 1.0% sodium carbonate finely ground to pass a 200 mesh (75 μm) screen was used to catalyze the oxidation. Specifications for asphalt roofing coating are met (Table II) and the oxidation time was less than the times for Examples IV, V, VI and VII. (FIG. 1)

EXAMPLE IX

The identical flux and process of Example V is used except 1.0% commercial grade sodium carbonate dissolved in water is used to catalyze the oxidation. The finished roofing coating product met specifications but was harder (lower penetration) than the products produced by Examples IV, V, VIII and VII. (Table II)

EXAMPLE X

The identical flux and process of Example V is used except only 0.5% sodium carbonate catalyst finely ground to pass a 200 mesh (75 μm) screen is used to catalyze the oxidation. The roofing coating product was produced in a time comparable to Examples VI, VII, VIII and IX. (FIG. 1) The main significance being in the quantity of catalyst required for the oxidation (0.5%) compared with (1.0%) used in Example VIII. (Table II, FIG. 1)

EXAMPLE XI

The identical flux and process of Example V is used except only 0.25% sodium carbonate catalyst ground to pass a 200 mesh (75 μm) screen is used to catalyze the oxidation. The roofing coating product thus produced meets specifications. (Table II) The oxidation time and the amount of catalyst required are significantly lower than those illustrated in Example IV through X. (FIG. 1)

THEORY

While the inventors do not wish to be held to any particular theory for the explanation of their invention, it does appear that the increase in surface area resulting from fine grinding will not, of itself, totally explain the advantages achieved by the invention. Other possible explanations are the disruption of the crystalline structure of normal commercial carbonate salt catalysts and also the reduction in particle size may assist in illuviation of the catalyst to avoid settling of the relatively dense catalyst in the relatively low density liquid bituminous flux. This reduction in particle size causing increased contact of the catalyst with the bituminous flux may also assist in the chemical combination or reaction of the bituminous flux with a portion of the catalyst.

Modifications

It will be understood to those skilled in the art that the present invention is not to be narrowly construed nor to be limited by the examples and that the invention is susceptible to a wide variety of variations and modifications, e.g. the oxidation of a wide variety of hydrocarbon feed materials, e.g. the aforementioned cylinder stock, slurry oil, cycle oil, furfural extracts and the like.

TABLE I

Comparison of AC-20 Paving Grade Asphalt Produced Without Catalyst, Commercial Grade Sodium Carbonate, and Finely Ground Sodium Carbonate Catalysts

| Test | Test Method | Starting Flux | 0% Catalyst | 1% Sod. Carbonate Catalyst | 1% Sod. Carbonate Catalyst | 0.5% Sod. Carbonate Catalyst | AASHTO Table II Specifications |
|---|---|---|---|---|---|---|---|
| Example No. | — | — | I | II | III | III | — |
| Particle Size, U.S. Standard Mesh (μm) | U.S. Standard Sieve | — | — | Comm. Grade Unground | <200 Mesh (75 μm) | <200 Mesh 75 μm) | — |
| Viscosity 140° F. (60° C.) Poise | ASTM D2171 | 56 | 1676 | 1907 | 1982 | 2000 | 1600–2400 |
| Penetration, 0.1 mm | ASTM D5 | Soft | 68 | 66 | 64 | 67 | 60 (minimum) |
| Viscosity @ 275° F. (135° C.) | ASTM D2170 | 75 | 324 | 339 | 345 | 335 | 300 (minimum) |
| Solubility, Trichloroethylene, % | ASTM D2042 | 99.8 | 99.9 | 99.0 | 99.0 | 99.5 | 99.0+ |
| Clay Gel Analysis: | | | | | | | |
| % Asphaltenes | ASTM D2007 | 10.9 | 23.0 | 20.1 | 20.4 | 20.0 | |
| % Saturates | | 21.4 | 19.5 | 4.5 | 9.8 | 7.6 | — |
| % Polar Comp. | | 38.6 | 31.8 | 44.4 | 42.7 | 43.5 | |
| % Aromatics | | 29.1 | 25.7 | 31.0 | 27.1 | 28.9 | |
| Oxidation Time, Hours | — | — | 8.0 | 3.5 | 3.25 | 3.20 | — |

TABLE II

Roofing Coating Asphalts Oxidized Without Catalyst Compared With Those Produced With Various Particle Sizes Of Sodium Sesquicarbonate and Sodium Carbonate Catalysts

| Example No. | Type Catalyst | Percent Catalyst | Particle Size Catalyst | Penetration 0.1 mm ASTM D5 | Softening Point, R. (°C.) ASTM D36 | Oxidation Time, Hours |
|---|---|---|---|---|---|---|
| Specifications | — | — | — | 17–23 | 220–235 | — |
| IV | 0 | 0 | 0 | 15 | 232 (111) | 6.0 |

TABLE II-continued

Roofing Coating Asphalts Oxidized Without Catalyst Compared With Those Produced With Various Particle Sizes Of Sodium Sesquicarbonate and Sodium Carbonate Catalysts

| Example No. | Type Catalyst | Percent Catalyst | Particle Size Catalyst | Penetration 0.1 mm ASTM D5 | Softening Point, °F. (°C.) ASTM D36 | Oxidation Time, Hours |
|---|---|---|---|---|---|---|
| V | Sodium Sesquicarbonate | 1.0 | Comm. Grade Unground | 19 | 226 (108) | 15.0 |
| VI | Sodium Sesquicarbonate | 1.0 | <200 Mesh (75 μm) | 18 | 234 (112) | 13.5 |
| VII | Sodium Carbonate | 1.0 | Comm. Grade Unground | 18 | 228 (109) | 13.0 |
| VIII | Sodium Carbonate | 1.0 | <200 Mesh (75 μm) | 19 | 228 (109) | 12.5 |
| IX | Sodium Carbonate | 1.0 | Comm. Grade (Water) | 17 | 235 (113) | 13.0 |
| X | Sodium Carbonate | 0.5 | <200 Mesh (75 μm) | 18 | 226 (108) | 13.0 |
| XI | Sodium Carbonate | 0.25 | <200 Mesh (75 μm) | 19 | 224 (107) | 11.0 |

What is claimed is:

1. In a process for producing high grade asphaltic material comprising oxidizing a bituminous material having a viscosity of about 30 to about 400 SFS at 210° F. (99° C.), at a temperature of from about 350° F. (177° C.) to about 550° F. (288° C.) by passing an oxidizing gas through the bituminous material in the presence of a catalyst, the improvement which comprises using as said catalyst a particulate carbonate salt having an average U.S. standard sieve size of less than about 200 mesh (75 μm).

2. A process according to claim 1 wherein the bituminous material which is oxidized contains from about 10 to about 20 weight percent alphaltenes, from about 15% to about 25% saturates and from about 20% to about 35% polar compounds, with the remainder of said bituminous material being substantially aromatic compounds and the high grade asphaltic material produced is a high grade paving asphalt.

3. A process according to claim 1 wherein the bituminous material which is oxidized contains from about 5% to about 15% asphaltenes, from 10% to about 35% saturates and from about 20% to about 35% polar compounds with the remainder of said bituminous material being aromatic compounds and the high grade asphaltic material produced is a high grade roofing, shingle-saturate or shingle-coating asphalt.

4. The process of claims 1, 2, or 3, wherein said bituminous material is selected from the group consisting of slurry oil, coal tar, coal tar pitch, petroleum pitch, cycle oils, asphalt, cylinder stock and liquids derived from oil shale, coal liquifaction materials, aromatic furfural extracts, normal paraffins and isoparaffins from solvent refining of lube oil and mixtures thereof, and extracts from the solvent extraction (conventional or supercritical) of bituminous residuals.

5. The process of claim 1 wherein said oxidation is carried out for about one-half to about six hours.

6. The process of claim 1 wherein said catalyst consists essentially of sodium carbonate ground so that 100% passes through 200 mesh (75 μm) U.S. sieve size.

7. A process according to claim 1, 2, or 3 wherein said catalyst is added in an amount ranging from about 0.25 to about 0.5 weight percent of said bituminous material.

8. The process of claim 2, wherein said oxidation is carried out for about 0.5 to 6 hours.

9. The process of claim 3, wherein said oxidation is carried out for about 2 to 35 hours.

10. A process according to claim 1, wherein said asphaltic material has an ASTM D5 penetration of from about 12 to 300 and an ASTM D36 softening point of about 110° to 250° F. (43° to 121° C.).

11. A process according to claim 2, wherein said asphaltic material has an ASTM D5 penetration ranging from about 40 to 300 and a an ASTM D36 softening point of about 110° to 140° F. (43° to 60° C.).

12. A process according to claim 3, wherein said asphaltic material is (1) asphalt for built-up roofing having an ASTM D5 penetration of from about 12 to 60 and an ASTM D36 softening point of from about 130° to 230° F. (54° to 110° C.); (2) roofing shingle saturant having an ASTM D5 penetration of from about 50 to 90 and an ASTM D36 softening point of from about 110° to 140° F. (43° to 60° C.) or; (3) roofing coating asphalt having an ASTM D5 penetration of about 15 to 25 and an ASTM D36 softening point of about 210° to 250° F. (99° to 121° C.).

13. A process according to claims 1, 2 or 3, wherein said catalyst is added in an amount ranging from about 0.1 to 2.0 weight percent of said bituminous material.

14. A process according to claims 1, 2 or 3, wherein said catalyst is added in an amount ranging from about 0.01 to 5.0 weight percent of said bituminous material.

15. A process according to claims 1, 2 or 3, wherein said catalyst is added in an amount ranging from about 0.1 to 1.0 weight percent of said bituminous material.

16. The process of claims 1, 2 or 3, wherein the reaction is conducted at a pressure of one atmosphere or above and the oxidizing gas is passed through the flux material at a rate ranging from about 15 to 35 cubic feet per hour, per ton, of flux material.

17. The process of claims 1, 2 or 3, wherein the process is carried out at a temperature of about between 480° to 550° F. (249° to 288° C.).

18. The process of claims 1, 2 or 3, wherein the oxidation process is carried at a temperature above the melting point of said bituminous material.

19. The process of claims 1, 2 or 3, wherein the catalyst is a mixture of sodium carbonate and bicarbonate.

20. The process of claim 9, wherein said catalyst is sodium carbonate or sodium sesquicarbonate.

21. The process of claim 10, wherein said catalyst is sodium sesquicarbonate.

22. The process of claim 10, wherein said catalyst is sodium carbonate.

23. The process of claim 9, wherein said catalyst is sodium bicarbonate.

24. The process of claims 1, 2 or 3, wherein the catalyst is a carbonate or bicarbonate salt of sodium, calcium, magnesium, cerium, barium, strontium, lithium, ammonium, potassium, bismuth, lead, tetraalkylphosphonium, tetraarylphosphonium, tetraalkylammonium, trialkylammonium, dialkylammonium, transition metals or rare earth metals.

25. The process according to claims 1, 2 or 3, wherein the saturate content of said asphaltic material is from about 25% to 85% of the saturates contained in said bituminous feedstock flux material.

26. The process according to claims 1, 2 or 3, wherein said asphaltic material has from about 25% to about 75% of the saturates contained in non-catalyzed oxidized identical bituminous feedstock flux material.

27. The process according to claims 1, 2 or 3, wherein said asphaltic material has from about 25% to about 75% of the saturates contained in Lewis acid catalyzed oxidized identical bituminous feedstock flux material.

28. The process according to claims 1, 2 or 3, wherein the oxidation time is reduced by at least about 10% as compared to the use of the same carbonate salt in commercial grade unground form.

29. The process of claims 1, 2 or 3, wherein the process is carried out in a continuous fashion.

30. The process of claims 1, 2 or 3, wherein the process is carried out in a batch fashion.

31. The process of claim 1, 2 or 3, wherein said catalyst is admixed with water or said liquid bituminous material and then the admixture is introduced into the bituminous material.

32. The process of claims 1 or 3, wherein prior to oxidation, a paraffin is introduced into the bituminous material to increase the saturate content thereof.

33. The process of claims 2, or 5, wherein said asphaltic material consists essentially of about 15% to 25% asphaltenes, about 3% to 15% saturates, about 30% to 50% polar compounds and 25% to 35% aromatics.

34. The process of claims 3, or 6, wherein said asphaltic material consists essentially of about 35% to 45% asphaltenes, about 5% to 30% saturates, about 30% to 40% polar compounds and about 10% to 30% aromatics.

* * * * *